US010047570B2

(12) United States Patent
Sui

(10) Patent No.: US 10,047,570 B2
(45) Date of Patent: Aug. 14, 2018

(54) ENERGIZED PAEK SEALS

(71) Applicant: Halliburton Energy Services, Inc., Houston, TX (US)

(72) Inventor: Ping Sui, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/037,390

(22) PCT Filed: Dec. 19, 2013

(86) PCT No.: PCT/US2013/076476
§ 371 (c)(1),
(2) Date: May 18, 2016

(87) PCT Pub. No.: WO2015/094268
PCT Pub. Date: Jun. 25, 2015

(65) Prior Publication Data

US 2016/0290060 A1 Oct. 6, 2016

(51) Int. Cl.

| | |
|---|---|
| ***E21B 33/128*** | (2006.01) |
| ***E21B 17/02*** | (2006.01) |
| ***E21B 33/12*** | (2006.01) |
| ***E21B 47/00*** | (2012.01) |

(52) U.S. Cl.
CPC ..... *E21B 17/02* (2013.01); *E21B 33/1208* (2013.01); *E21B 47/00* (2013.01)

(58) Field of Classification Search
CPC ..... E21B 33/10; E21B 33/12
See application file for complete search history.

(56) References Cited

U.S. PATENT DOCUMENTS 5,368,312 A 11/1994 Voit et al.
5,842,701 A * 12/1998 Cawthorne ..... E21B 10/25 277/336
6,007,070 A 12/1999 Heathcott et al.
6,315,497 B1 * 11/2001 Wittman ..... E21B 17/015 138/33
6,821,147 B1 11/2004 Hall et al.
(Continued)

FOREIGN PATENT DOCUMENTS

CN 1231683 10/1999
WO 2010-148028 12/2010

OTHER PUBLICATIONS

International Search Report and Written Opinion, Application No. PCT/US2013/076476, 14 pages, dated Sep. 23, 2014.
(Continued)

*Primary Examiner* — Gilbert Y Lee
(74) *Attorney, Agent, or Firm* — Baker Botts L.L.P.

(57) ABSTRACT

An example downhole tool may include a first component and a second component. A first seal may be positioned between the first component and the second component, and a first energizer may be positioned between the first seal and the first component. The first seal may comprise a polyaryletherketone (PAEK) material. The first energizer may be a compressible material. The PAEK material may be at least one of polyetherketone (PEK), polyether ether ketone (PEEK), polyetherketoneketone (PEKK), polyehtherether-ketoneketone (PEEKK), and polyetherketoneether-ketoneketone (PEKEKK).

5 Claims, 3 Drawing Sheets

(56) References Cited

U.S. PATENT DOCUMENTS

| | | | | |
|---|---|---|---|---|
| 6,948,715 | B2 | 9/2005 | Taylor et al. | |
| 2003/0107217 | A1 | 6/2003 | Daigle et al. | |
| 2006/0061099 | A1 | 3/2006 | Lewis et al. | |
| 2007/0075502 | A1 | 4/2007 | Ota et al. | |
| 2010/0237565 | A1 | 9/2010 | Foster | |
| 2010/0237566 | A1 | 9/2010 | Balsells et al. | |
| 2011/0006486 | A1 | 1/2011 | Niknezhad | |
| 2011/0140369 | A1 | 6/2011 | Lenhert | |
| 2012/0224962 | A1 | 9/2012 | Tabata et al. | |
| 2013/0043661 | A1 | 2/2013 | Binder et al. | |
| 2013/0306331 | A1* | 11/2013 | Bishop | E21B 33/128 166/387 |
| 2015/0102247 | A1* | 4/2015 | Leboeuf | F16K 41/04 251/214 |

OTHER PUBLICATIONS

International Preliminary Report on Patentability for PCT Patent Application No. PCT/US2013/076476, dateded Jun. 30, 2016; 10 pages.

Office Action for Chinese Patent Application No. 201380080443.X, dated Jun. 2, 2017; 17 pages.

Office Action for Chinese Patent Application No. 2013/80080443.X, dated Jan. 3, 2018; 12 pages.

* cited by examiner

ENERGIZED PAEK SEALS

RELATED APPLICATIONS

This application is a U.S. National Stage Application of International Application No. PCT/US2013/076476 filed Dec. 19, 2013, which designates the United States, and which is incorporated herein by reference in its entirety.

BACKGROUND

The present disclosure relates generally to well drilling operations and, more particularly, to energized polyaryletherketone (PAEK) seals.

Hydrocarbon recovery drilling operations typically require boreholes that extend thousands of meters into the earth. The drilling operations themselves can be complex, time-consuming and expensive and may require transportation of fluids through pipes, pipelines, and other fluid conduits under high pressure and temperature conditions. Maintaining pressure within the fluid conduits is important for safety and environmental reasons.

FIGURES

Some specific exemplary embodiments of the disclosure may be understood by referring, in part, to the following description and the accompanying drawings.

Figure 1:
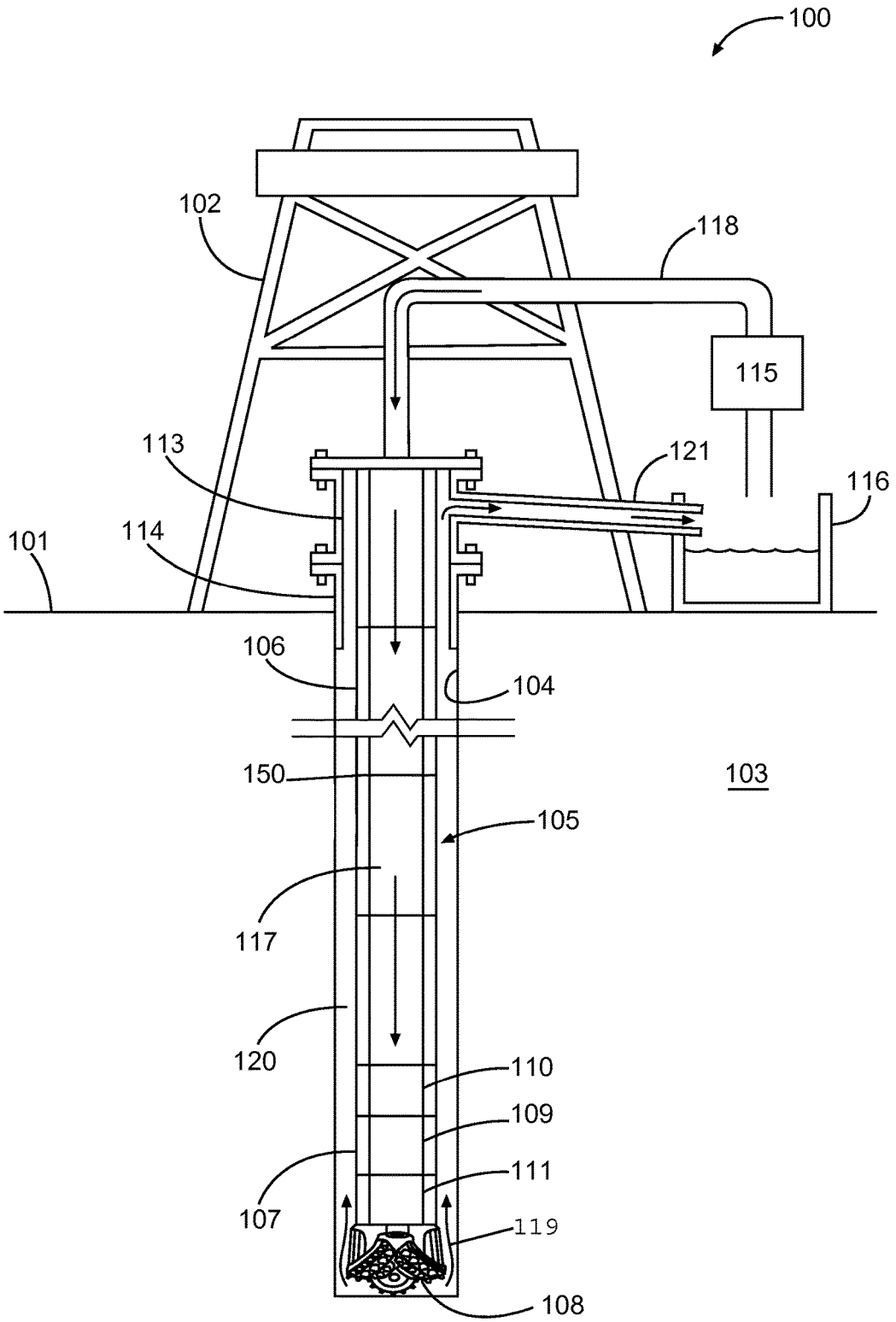
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

FIG. 1 is a diagram illustrating an example drilling system 100, according to aspects of the present disclosure. The drilling system 100 includes rig 102 mounted at the surface 101 and positioned above borehole 104 within a subterranean formation 103. The formation 103 may be comprised of at least one rock strata. Although the drilling system 100 is shown on land, a similar drilling system may be used in an offshore drilling environment, where surface 101 comprises a drilling platform separated by the formation 103 by a volume of water.

In the embodiment shown, a drilling assembly 105 may be positioned within the borehole 104 and coupled to the rig 102. The drilling assembly 105 may comprise drill string 106 and bottom hole assembly (BHA) 107. The drill string 106 may comprise a plurality of pipe segments threadedly connected at joints, such as joint 150. The BHA 107 may comprise a drill bit 108, a measurement-while-drilling/logging while drilling (MWD/LWD) apparatus 109, a telemetry system 110, and a reamer 111. The MWD/LWD apparatus 109 may comprise multiple sensors through which measurements of the formation 103 may be taken. The reamer 111 may comprise extendable arms that contact the wall of the borehole 104 to increase the diameter of the borehole 104 behind the drill bit 108. The BHA 107 including the MWD/LWD apparatus 109 and reamer 111 may be communicably coupled to the surface through the telemetry system 110, which may receive/transmit information between the BHA 107 and the surface 101. Each of the drill bit 108, MWD/LWD apparatus 109, telemetry system 110, and reamer 111 may be coupled to an adjacent portion of the drilling assembly 105 at a threaded joint.

The drill string 106 may extend downward through a surface tubular 113 into the borehole 104. The surface tubular 113 may be coupled to a wellhead 114. The wellhead 114 may include a portion that extends into the borehole 104. In certain embodiments, the wellhead 114 may be secured within the borehole 104 using cement, and may work with the surface tubular 113 and other surface equipment, such as a blowout preventer (BOP) (not shown), to prevent excess pressures from the formation 103 and borehole 104 from being released at the surface 101.

During drilling operations, a pump 115 located at the surface 101 may pump drilling fluid from a fluid reservoir 116 into an inner bore 117 of the drill string 106. The pump 115 may be in fluid communication with the inner bore 117 through at least one fluid conduit or pipe 118 between the pump 115 and drill string 106. As indicated by arrows 119, the drilling fluid may flow through the interior bore 117 of drill string 106, the BHA 107, and the drill bit 108 and into a borehole annulus 120. The borehole annulus 120 is created by the rotation of the drill bit 108 in borehole 104, and is defined as the space between the interior/inner wall or diameter of borehole 104 and the exterior/outer surface or diameter of the drill string 106. The annular space may extend out of the borehole 104, through the wellhead 114 and into the surface tubular 113. Fluid pumped into the borehole annulus 120 through the drill string 106 may flow upwardly, exit the borehole annulus 120 into the surface tubular 113, and travel to the surface reservoir 116 through a fluid conduit 121 coupled to the surface tubular 113 and the surface reservoir 116.

According to aspects of the present disclosure, seal assemblies with PAEK seals may be used with the drilling system 100 and in other aspects of hydrocarbon recovery and production operations to maintain downhole pressures. Maintaining pressure within the bore 117 and the borehole annulus 120 may be important to preventing blowouts or other losses of fluid containment. Formation fluids may be held in the formation 103 under pressure and may escape if the pressure within the annulus 120 is less than the formation pressure. The drilling fluid may be pumped into the bore 117 at a particular pressure and flow rate, intended to maintain a pressure within the annulus 120 above the formation pressure but below a pressure at which the drilling fluid penetrates the formation. Fluid leaks through the joints may cause unwanted pressure fluctuations that can lead to blowouts.

Additionally, seal assemblies with PAEK seals also may be used with the drilling system 100 and in other aspects of hydrocarbon recovery and production operations to maintain downhole hydraulic fluid systems in which hydraulic fluid is stored and pumped to achieve some purpose or action downhole. For example, the reamer 111 may have a hydraulic fluid system that is used to extend the reamer arms. When pressure is lost in the hydraulic fluid system (e.g., when a seal is broken), the reamer 111, or any other tool with a hydraulic fluid system, may cease to function. When a downhole tool stops functioning, the entire drilling assembly 105 must be removed from the borehole 104 and the tool replaced, increasing the time and expense of the drilling operation. Other downhole hydraulic fluids systems may be used, for example, in drill bits, downhole steering systems, LWD/MWD tools, extendable stabilizer systems, inflatable packers, and other downhole elements or tools that would be appreciated by one of ordinary skill in the art in view of this disclosure.

According to aspects of the present disclosure, seal assemblies with PAEK seals also may be used with the drilling system 100 and in other aspects of hydrocarbon recovery and production operations to protect sensitive equipment from downhole temperatures, pressures, and fluids. Downhole measurement tools may require clean environments in which to operate and take measurements, and seals may be used to prevent sensitive measurements equipment from being exposed to drilling or formation fluids. For example, the bore 117 through the drilling assembly 105 may extend through the LWD/MWD apparatus 109, which may include sensitive measurement devices, such as magnetometers, accelerometers, antennas, electrodes, etc. Exposure to the drilling fluids may degrade the measurement devices and reduce their useful life, requiring removal of the drilling assembly 105 from the borehole 104 in order to replace the LWD/MWD apparatus 109.

Figure 2:
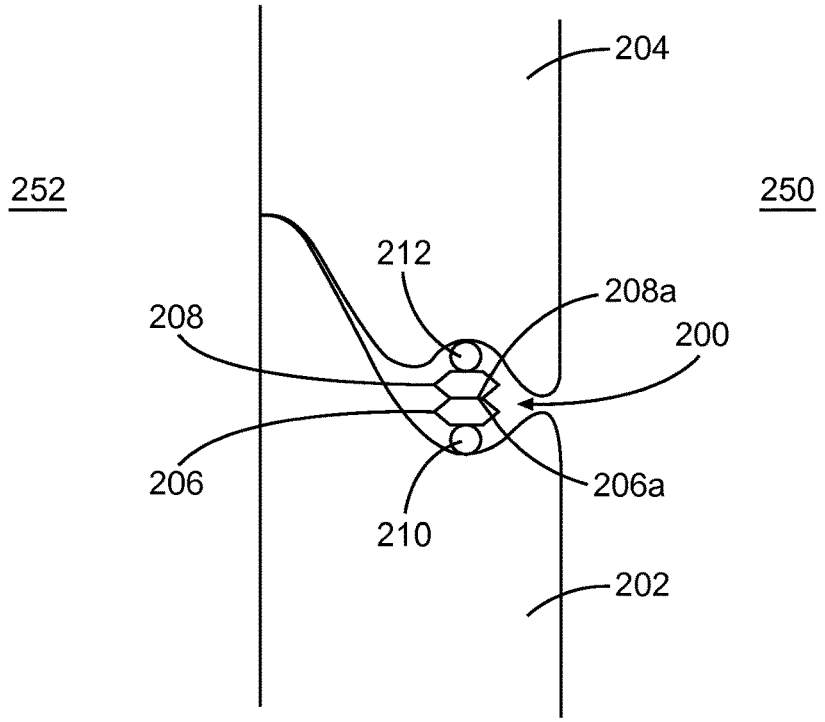
FIG. 2 is a diagram illustrating an example seal assembly, according to aspects of the present disclosure.

FIG. 2 is a diagram illustrating an example seal assembly 200 with PAEK seals, according to aspects of the present disclosure. In the embodiment shown, the seal assembly 200 is positioned between a first component 202 of a downhole tool and a second component 204 of the downhole tool. The first component 202 and second component 204 may comprise one of adjacent pipe segments in a drill string, adjacent components within a BHA, components of a hydraulic fluid system, and/or components within a downhole tool, such as a LWD/MWD apparatus or a wireline measurement or survey tool. The seal assembly 200 may provide a hermetic and fluid-resistant seal between a first side 250 of the components and a second side 252 of the components. Other configurations for the first and second components 202 and 204 are possible, as are different placements and orientations of the seal assembly 200 with respect to the first and second components 202 and 204.

In the embodiment shown, the seal assembly 200 comprises a first seal 206 positioned proximate to the first component 202. A first energizer 210 may be adjacent to the first seal 206, between the first seal 206 and the first component 202. The seal assembly 200 may further comprise a second seal 208 positioned proximate to the second component 204. A second energizer 212 may be adjacent to the second seal 208, between the second seal 208 and the second component 204. The first energizer 210 and second energizer 212 may comprise compressible or deformable materials with similar length dimensions to the respective first seal 206 and second seal 208 that, when compressed or deformed, exert forces on at least the respective first seal 206 and second seal 208 such that there is sufficient force between the seals 206 and 208 to engage or "energize" the seal assembly 200.

At least one of the first seal 206 and the second seal 208 may comprise a PAEK seal. As used herein, a PAEK seal may comprise a seal that is at least partially composed of a PAEK material. PAEK material comprises a family of semi-crystalline thermoplastics characterized by robust mechanical and chemical resistance properties that are retained at high temperatures and pressures. Materials in the family of PAEK materials include but are not limited to polyetherketone (PEK), polyether ether ketone (PEEK), polyetherketoneketone (PEKK), polyehtheretherketoneketone (PEEKK), and polyetherketoneetherketoneketone (PEKEKK). PEEK, for example, may have a Young's modulus on the order of about 3.6 gigapascals, a tensile strength on the order of about 90 to 100 megapascals, a glass transition temperature at around 143° C. (289° F.), and a melting point at around 343° C. (662° F.). Downhole environments normally have high temperatures and pressures and contain caustic fluids, all of which may degrade typical seals. Accordingly, the use of PAEK material may improve the useful life of the seal due to the material's highly resistance to thermal degradation as well as attack by both organic and aqueous environments.

At least one of the first energizer 210 and the second energizer 212 may comprise a compressible material such as rubber which exerts outward forces on the surfaces with which they are in contact when compressed. In the embodiment shown, the first seal 206 may contact the second seal 208 when the first component 202 and the second component 204 are positioned proximate to each other. When the first component 202 is urged toward the second component 204, the first seal 206 may contact the second seal 208, and the force used to urge the first component 202 toward the second component 204 may cause the first energizer 210 to compress. The force further may cause the second energizer 212 to compress. Once compressed, the first energizer 210 may exert outward forces on the first component 202 and the first seal 206, forcing the first seal 206 toward the second seal 208. Likewise, the second energizer 212, once compressed, may exert an outward force on the second component 204 and the second seal 208, forcing the second seal 208 toward the first component 202 and the first seal 206. Notably, PAEK material may be resistant to compression, and the force provided by one or more of the first energizer 210 and second energizer 212 may ensure sufficient contact between the first seal 206 and the second seal 208 to maintain a hermetic and fluid-resistant seal.

In certain embodiments, at least one of the first seal 206 and the second seal 208 may comprise at least one planar or flat surface. In the embodiment shown, each of the first seal 206 and second seal 208 comprise six flat surfaces. At least one flat surface on each of the first seal 206 and second seal 208 may be aligned when the first seal 206 and the second seal 208 are in contact with each other. A first flat surface 206*a* of the first seal 206 may be in contact with a second flat surface 208*a* of the second seal 208.

In certain embodiments, the first seal 206 may comprise a PAEK material and the second seal 208 may comprise a non-PAEK wear resistant material, such as metal or diamond. For example, the second seal 208 may comprise a steel ring positioned proximate to the second component 204, with the second energizer 212 positioned between the steel ring and the second component 204. The steel ring may have at least one planar surface to contact the first seal 206 to form a seal between the first component 202 and the second component 204.

Figure 3:
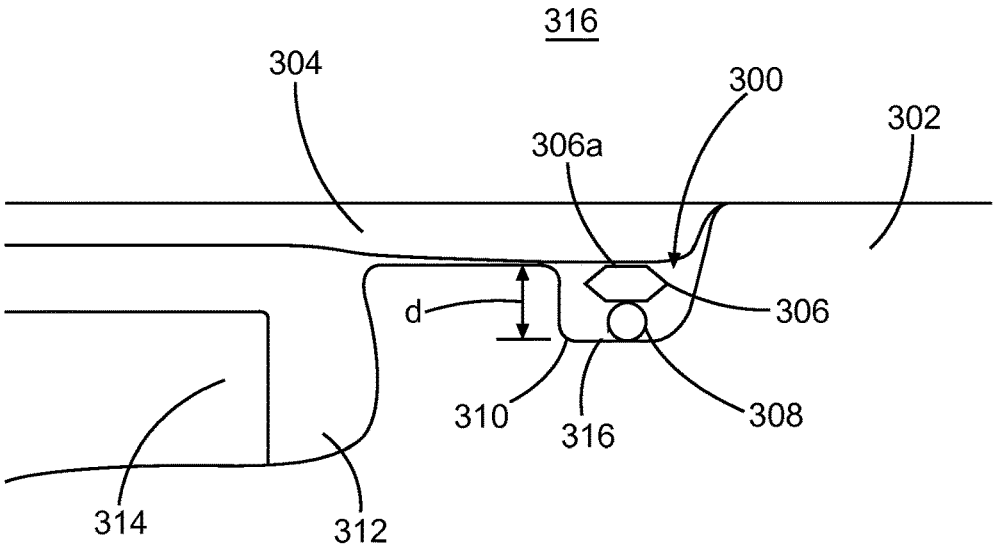
FIG. 3 is a diagram illustrating another example seal assembly, according to aspects of the present disclosure.

FIG. 3 is a diagram illustrating an example seal assembly 300 with a PAEK seal, according to aspects of the present disclosure. In the embodiment shown, the seal assembly 300 is positioned between a first component 302 of a downhole tool and a second component 304 of a downhole tool. The first component 302 may comprise the body of a downhole measurement tool, such as a LWD/MWD apparatus or a wireline measurement or survey tool, and the second component 304 may comprise a hatch or cover positioned over a recess 312 within the first component 302. The hatch or cover may be comprised of metal or other wear resistant material. In certain embodiments, one or more measurement devices 314 may be positioned within the recess 312, and the hatch 304 may be positioned over the recess 312 to protect the measurement device 314 from exposure to particulates and fluids 316 outside of the hatch 304. The particulates and fluid 316 may comprise drilling fluids, formation fluids, and particulates generated during the drilling process.

The seal assembly 300 may be positioned between the hatch 304 and the body 302 and at least partially disposed in a seal gland 316 of the first component 302, and may provide a hermetic and fluid-resistant seal between the recess 312 and the particulates and fluids 316 outside of the tool. In certain embodiments, the seal glad 316 may be located on the hatch 304. In the embodiment shown, the seal assembly 300 comprises a first seal 306 and a first energizer 308. Although only one seal and energizer are shown, others may be included within the seal assembly 300, similar to the seal assembly 200. Likewise, seal assembly 200 may have only one seal and energizer.

The first seal 306 may comprise a PAEK material and the first energizer 308 may comprise a compressible material. The notched area 316 may have a depth "d" within the first component 302. In certain embodiments, the first seal 306 and first energizer 308 in an uncompressed state may have a combined height greater than the depth "d", so that the first seal 306 extends outside of the seal gland 316. When the hatch 304 is in place with respect to the first component 302, the hatch 304 may compress the first energizer 308 and cause the first energizer 308 to exert force on the first seal 306 and the first component 302. The force from the first energizer 308 may cause the first seal 306 to engage with and seal against the hatch 304. The first seal 306 may comprise at least one flat or planar surface. In the embodiment shown, the first seal 306 comprises six planar surfaces, and at least one planar surface 306*a* of the first seal 306 may contact and engage with the second component 304.

Although FIG. 3 is described above in relation to a LWD/MWD apparatus, the seal assembly 300 and the configuration shown FIG. 3, or a similar configuration, may be equally applicable to other downhole applications. For example, the first component 302 may comprise the body of a downhole tool with hydraulic fluid system, such as a reamer, and the second component 304 may comprise a hatch or cover positioned over a hydraulic fluid chamber 312 within the first component 302. The seal assembly 300 may function substantially as described above, with the purpose being to ensure that pressure within the hydraulic fluid system and chamber 312 is maintained.

Figure 4:
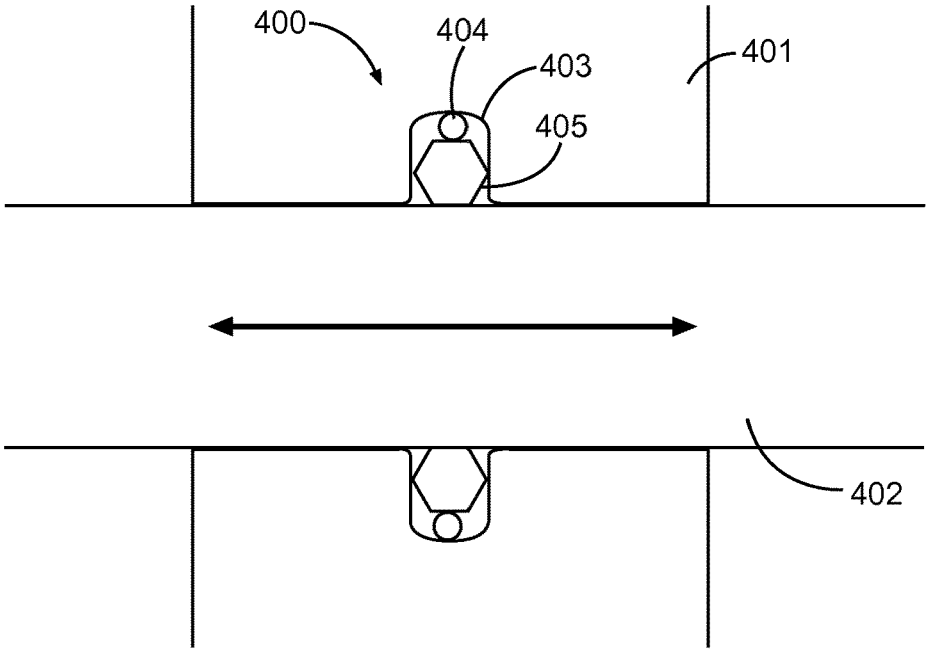
FIG. 4 is a diagram illustrating another example seal assembly, according to aspects of the present disclosure

In addition to the seals described above, PAEK seals may also be used as dynamic seals, according to aspects of the present disclosure. Specifically, a PAEK seals may be used between first and second components where there is relative motion between the first and second components. The relative motion may comprise, for example, axial motion or radial motion. FIG. 4 is a diagram of an example PAEK seal assembly 400, according to aspects of the present disclosure. The PAEK seal assembly 400 may be positioned between a first component 401 of a downhole tool and a second component 402 of a downhole tool in a seal gland 403 in the first component 401. In certain embodiments, the seal glad 403 may be within the second component 402. The PAEK seal assembly 400 may comprise a PAEK seal 405 and energizer 404 that engages with an outer surface of the second component 402. The second component 402 may comprise a shaft or portion of a piston that moves axially with respect to the first component 401, which may be fixed. The PAEK seal 405 may remain in a sealing engagement with the surface of the second component 402, as the second component 402 moves with respect to the first component 401.

Figure 5:
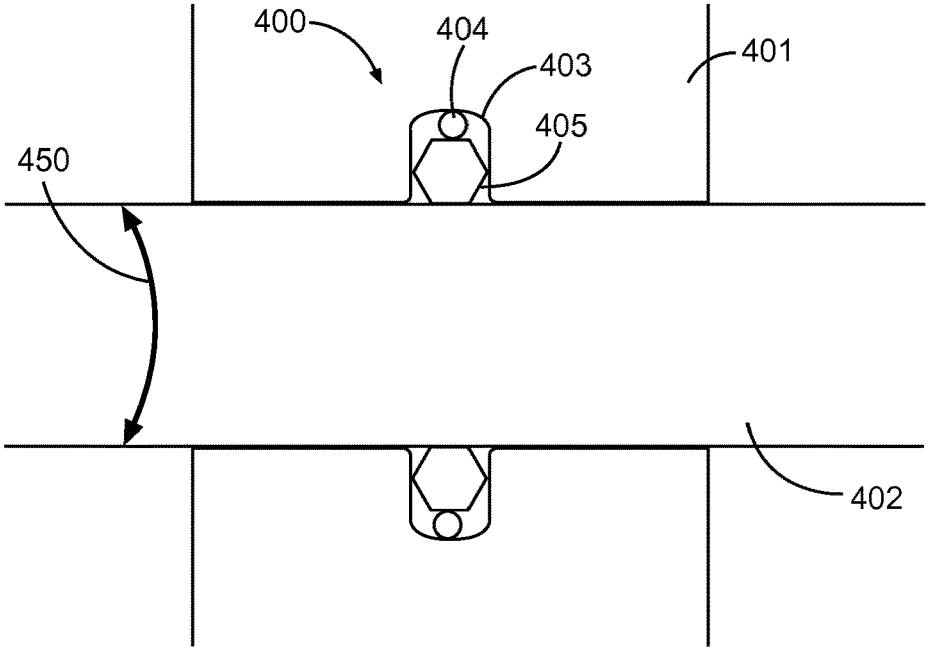
FIG. 5 is a diagram illustrating another example seal assembly, according to aspects of the present disclosure.

FIG. 5 is a diagram of the example PAEK seal assembly 400, according to aspects of the present disclosure, where the first component 401 and the second component 402 move radially with respect to one another. Specifically, the second component 402 may comprise a rotating shaft that rotates radially as indicated by arrow 450, with respect to the first component 401, which remains fixed. In other embodiments, the shaft 402 may remain fixed while the first component 401 rotates. In both instances, the PAEK seal 405 may remain in a sealing engagement with the second component 402

According to aspects of the present disclosure, an example downhole tool may include a first component and a second component. A first seal may be positioned between the first component and the second component, and a first energizer may be positioned between the first seal and the first component. The first seal may comprise of a polyaryletherketone (PAEK) material. The first energizer may comprise a compressible material. The PAEK material may be at least one of polyetherketone (PEK), polyether ether ketone (PEEK), polyetherketoneketone (PEKK), polyehtheretherketoneketone (PEEKK), and polyetherketoneetherketoneketone (PEKEKK).

In certain embodiments, the downhole tool may further include a second seal positioned between the first seal and the second component. A second energizer may be positioned between the second seal and the second component. The second seal may also comprise a PAEK material. The first seal further may comprise a planar or flat surface that is in contact with the second component. Where a second seal is present, both the first seal and the second seal may have planar or flat surfaces. The planar or flat surfaces of the first seal and second seal may be in contact with each other.

In certain embodiments, the first component may be a first pipe segment of a drill string and the second component may be a second pipe segment of a drill string. The first seal may be positioned proximate to a threaded joint between the first component and the second component. In other embodiments, one of the first component and the second component may be a tool body for a downhole tool that includes a recessed portion. The other one of the first component and the second component may be a hatch or cover positioned over the recessed portion.

According to aspects of the present disclosure, and example method may include positioning a first component proximate to a second component and positioning a first seal between the first component and the second component. The first seal may comprise a polyaryletherketone (PAEK) material. A first energizer may be positioned and compressed between the first seal and the first component. In certain embodiments, the first energizer may comprise a compressible material. The PAEK material comprises at least one of polyetherketone (PEK), polyether ether ketone (PEEK), polyetherketoneketone (PEKK), polyehtheretherketoneketone (PEEKK), and polyetherketoneetherketoneketone (PEKEKK).

In certain embodiments, the method may further include positioning a second seal between the first seal and the second component. A second energizer may be positioned and compressed between the second seal and the second component. The second seal may at least one of a PAEK material and/or metal. The first seal may comprises at least one planar or flat surface, and compressing the first energizer may comprise causing the at least one planar or flat surface to contact the second component. Where there is a second seal, the second seal may comprise at least one second planar or flat surface, and compressing the first energizer may comprise causing the at least one first planar or flat surface to contact the at least one second planar or flat surface In certain embodiments, positioning a first component proximate to a second component may comprise positioning a first pipe segment of a drill string proximate to a second pipe segment of a drill string. And positioning the first seal between the first component and the second component may comprise positioning the first seal proximate to a threaded joint between the first pipe segment and the second pipe segment. In other embodiments, positioning the first component proximate to the second component may comprise positioning a hatch or cover over a recessed portion in a downhole tool body.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the component that it introduces.

What is claimed is:

1. A downhole tool comprising a first component of the downhole tool comprising a tool body that includes a recessed portion and a hydraulic fluid chamber within the recessed portion;

a second component of the downhole tool comprising a hatch or cover positioned over the recessed portion;

a first seal positioned between the first component and the second component and comprised of a polyaryletherketone (PAEK) material; and a first energizer positioned between the first seal and the first component, wherein the first seal and first energizer provide a hermetic and fluid-resistant seal between the first component and the second component.

2. The downhole tool of claim 1, further comprising a second seal positioned between the first seal and the second component; and a second energizer positioned between the second seal and the second component, wherein the first seal and first energized and second seal and second energizer provide a hermetic and fluid resistant seal between the first component and the second component.

3. The downhole tool of claim 2, wherein the second seal comprises at least one of PAEK material and/or metal.

4. The downhole tool of claim 1, wherein the first seal comprises at least one planar or flat surface in contact with the second component.

5. The downhole tool of claim 1, wherein the first seal comprises at least one first planar or flat surface;

the second seal comprises at least one second planar or flat surface; and at least one first planar or flat surface is in contact with the at least one second planar or flat surface.

* * * * *